US005833790A

United States Patent [19]

Hare

[11] Patent Number: 5,833,790

[45] Date of Patent: Nov. 10, 1998

[54] METHODS FOR REUSING ARTWORK AND CREATING A PERSONALIZED TEE-SHIRT

[75] Inventor: Donald S. Hare, Hawley, Pa.

[73] Assignee: Foto-Wear, Inc., Milford, Pa.

[21] Appl. No.: 770,043

[22] Filed: Dec. 19, 1996

[51] Int. Cl.[6] ..... B44C 1/16

[52] U.S. Cl. ..... 156/240; 156/230

[58] Field of Search ..... 156/230, 277, 156/240, 235; 355/75; 399/377, 378

[56] References Cited

U.S. PATENT DOCUMENTS

| | | | |
|---|---|---|---|
| 1,916,282 | 7/1933 | Peacock . | |
| 3,025,778 | 3/1962 | Stuckens . | |
| 3,152,528 | 10/1964 | Pendry . | |
| 3,619,573 | 11/1971 | Philip et al. . | |
| 3,721,173 | 3/1973 | Jaffe . | |
| 4,009,954 | 3/1977 | Ritzerfeld . | |
| 4,224,358 | 9/1980 | Hare . | |
| 4,241,994 | 12/1980 | Ryan, Jr. . | |
| 4,284,456 | 8/1981 | Hare . | |
| 4,309,102 | 1/1982 | Pudark et al. . | |
| 4,328,051 | 5/1982 | Robinette . | |
| 4,334,771 | 6/1982 | Ryan, Jr. . | |
| 4,512,658 | 4/1985 | Winkelmann | 355/75 X |
| 4,773,953 | 9/1988 | Hare . | |
| 4,966,815 | 10/1990 | Hare . | |
| 4,975,731 | 12/1990 | Overholt . | |
| 4,975,735 | 12/1990 | Bright . | |
| 4,980,224 | 12/1990 | Hare . | |
| 4,980,781 | 12/1990 | Yamamoto et al. | 355/75 X |
| 5,030,995 | 7/1991 | Bolton . | |
| 5,068,742 | 11/1991 | Oshikoshi et al. . | |
| 5,114,139 | 5/1992 | Kodama | 355/75 X |
| 5,139,917 | 8/1992 | Hare . | |
| 5,236,801 | 8/1993 | Hare . | |
| 5,242,739 | 9/1993 | Kronzer et al. . | |
| 5,271,990 | 12/1993 | Kronzer et al. . | |
| 5,337,119 | 8/1994 | Tanibata . | |
| 5,422,737 | 6/1995 | Atoji et al. | 355/75 X |
| 5,467,165 | 11/1995 | Jacob et al. . | |
| 5,486,897 | 1/1996 | Mohmand . | |
| 5,501,902 | 3/1996 | Kronzer . | |
| 5,574,542 | 11/1996 | Brook, III | 355/75 X |
| 5,575,877 | 11/1996 | Hale et al. | 156/230 X |
| 5,659,838 | 8/1997 | Ando et al. | 399/377 X |

FOREIGN PATENT DOCUMENTS

| | | |
|---|---|---|
| 2 678552A | 1/1993 | France . |
| WO90 00473 | 1/1990 | WIPO . |

*Primary Examiner*—Curtis Mayes
*Attorney, Agent, or Firm*—Birch, Stewart, Kolasch & Birch, LLP

[57] ABSTRACT

The present invention relates to a method of creating personalized, transferable artwork, which comprises the steps of selecting artwork or preselected images, inserting said artwork or preselected images into a clear folder or beneath a clear sheet, said clear folder or clear sheet having no printing or form-work thereon and being capable of being written upon, handwriting onto the clear folder or clear sheet, thereby personalizing said clear folder or clear sheet, copying said art-work or preselected images and said clear folder or clear sheet having handwriting thereon onto a transfer material, and transferring said art-work or preselected images together with said handwriting onto a receptor element, thereby preserving the original artwork for reuse. The invention demonstrates the only way personalization, such as handwriting, can be transferred onto a receptor element, such as a shirt, in correct order using equipment without an electronic reverse imaging capability.

29 Claims, 1 Drawing Sheet

METHODS FOR REUSING ARTWORK AND CREATING A PERSONALIZED TEE-SHIRT

BACKGROUND OF THE INVENTION

Tee shirts with images thereon may be purchased at stores all over the world. The customer often selects a decal from a preexisting inventory of decals and the shop owner then applies the selected decal to the tee shirt, typically with a large, commercial hot press iron. During this process, the original decal is used only once during the transfer process since it is physically applied to the tee shirt. There is no known process for recovering and reusing the original decal, and there exists no technique for personalizing a tee shirt without the assistance of a personal computer or going through the costly process of reproducing onto a commercial offset printer.

SUMMARY OF THE INVENTION

Accordingly, it is an object of the invention to utilize a process where the original artwork is preserved and protected, thereby reducing costs to the merchant selling the tee shirt.

Another object of the invention is to provide the merchant with a process where the merchant would not run out of inventory, since he will never run out of the original design. Thus, the merchant will not lose business due to lack of inventory.

Further, it is an object of the invention to personalize artwork that may be transferred to a tee shirt or other receptor element without the use of a computer literate employee.

As a result of the present invention, no personal computers are necessary for personalizing the tee shirt. This reduces costs for store management by avoiding the need for training employees on the use of computers. Thus, as a result of the invention, the merchant will save costs with respect to the purchase of computer hardware and software, and the maintenance thereof.

Accordingly, the present invention relates to a method of reusing artwork used in tee shirt transfers, which comprises the steps of: (step i) selecting pre-existing artwork (i.e. decals; text) or creating original artwork (i.e. paintings, drawings, text or pictures), (step ii) inserting said selected pre-existing artwork or created original artwork into a folder having a first member and a second member wherein at least one of the first or second members is clear and transparent (i.e. plastic, glass) or inserting said selected pre-existing artwork or created original artwork beneath a clear, transparent sheet (i.e. plastic, glass), said clear folder or clear sheet having decorative borders or artwork thereon that will be visible on the final image to be transferred, (step iii) reproducing said selected pre-existing art-work or created original artwork and said clear folder or clear sheet onto a transfer material (i.e. reproducing by copying with the first member of the folder face down on the copier onto a transfer material, or by copying with the sheet face down on the copier and the artwork on top of the sheet onto a transfer material; or reproducing by scanning the image into a computer and outputting to a printer onto a transfer material), and (step iv) transferring said selected art-work or created artwork onto a receptor element. The artwork in the folder or above the sheet as oriented in the copier may then be recovered for reuse.

The present invention further relates to a method of creating personalized, transferable artwork, which comprises the steps of: (step i) selecting pre-existing artwork (i.e. decals; text) or creating original artwork (i.e. paintings, drawings, text or pictures), inserting said pre-existing artwork or created original artwork into a folder having a first member and a second member wherein at least one of the first or second members is clear and transparent (i.e. plastic, glass), or inserting said pre-existing artwork or created original artwork beneath a clear, transparent sheet (i.e. plastic, glass), said clear folder or clear sheet having no printing or form-work thereon that will be visible on the final image to be transferred and being capable of being written upon, hand-writing onto the clear folder or clear sheet, thereby personalizing said clear folder or clear sheet, (step ii) reproducing said selected pre-existing art-work or created original artwork and said clear folder or clear sheet having handwriting thereon onto a transfer material (i.e. reproducing by copying with the first member of the folder face down on the copier onto a transfer material, or by copying with the sheet face down on the copier and the artwork on top of the sheet onto a transfer material; or reproducing by scanning the image into a computer and outputting to a printer onto a transfer by scanning into a computer and outputting to a printer onto a transfer material), and (step iii) transferring said pre-existing art-work or created original artwork together with said handwriting onto a receptor element. The artwork in the folder or above the sheet as placed on top of the copier may then be recovered and the folder or sheet may be erased for reuse later. In (step i), the order of the substeps is not important. For instance, the desired message can be written onto the folder or sheet prior to selection of or creation of the artwork.

BRIEF DESCRIPTION OF THE DRAWINGS

The present invention will become more fully understood from the detailed description given hereinbelow, and the accompanying FIGURE which are given by way of illustration only, and thus are not limitative of the present invention, and wherein.

DETAILED DESCRIPTION OF THE INVENTION

Figure 1:
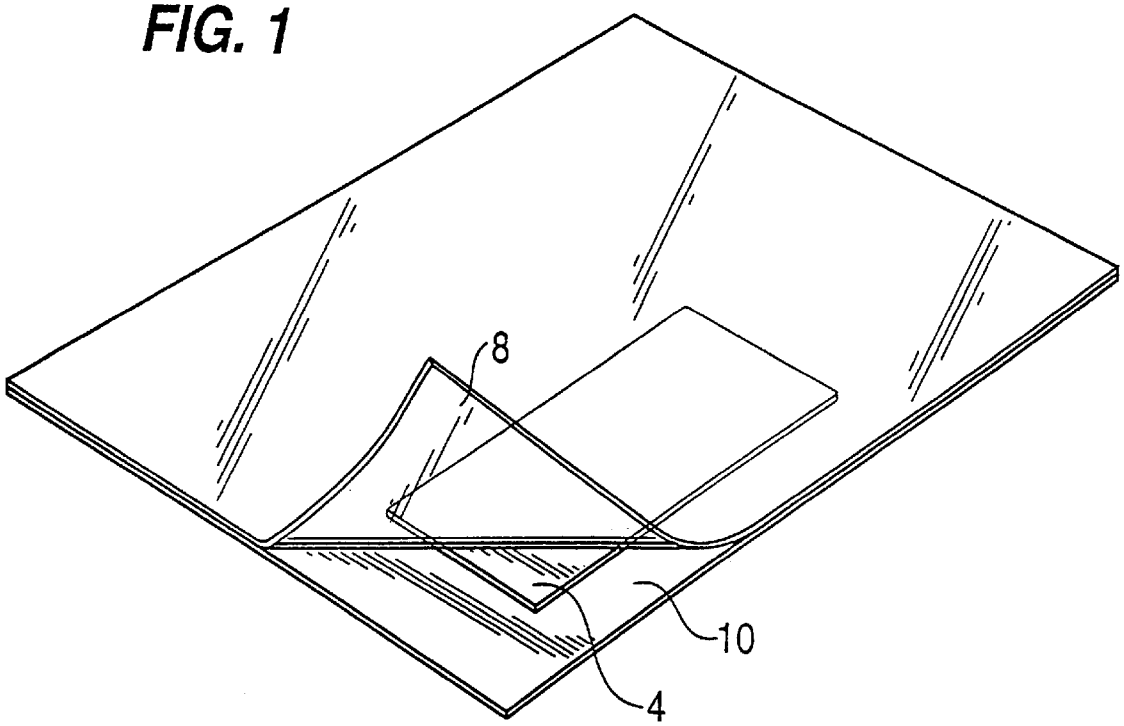
FIG. 1 shows a folder of the invention.

In one embodiment of the invention, a plurality of pre-existing pieces of artwork are each protected by a folder of clear, protective material so that the "master" piece of artwork may be used over and over again. This first embodiment of the invention does not require any training of the user concerning the use of a computer, since original "masters" of the pre-existing artwork can be sealed within suitable folders (i.e. plastic or glass) or inserted beneath a protective sheet (i.e. plastic or glass) for reuse time and time again.

In another embodiment of the invention, the "master" pieces of artwork are not limited to a finite number which are presealed for protection. Virtually any image can be scanned into a computer by commercially available scanners or images may be selected or downloaded from any number of computer databases that are available, including from the internet. In fact, artwork may be created for the first time on a home computer and used in the invention. In any event, the artwork may be locally printed from any database to obtain the created original artwork to be transferred, and the original image may be maintained on the computer database for reuse over and over again, or for the creation of several hardcopy "masters". The original "master" image is not electronically manipulated. Briefly, the desired image (i.e.

artwork) is printed from the computer, the personalized handwritten message is then placed directly onto the hard-copy print-out, and the composite artwork/handwriting is scanned back into the computer for printing onto transfer paper. Or, the personalized message alone may be scanned into a computer file and merged with the artwork to create a composite image file containing artwork and handwritten message, which is then outputted to a printer containing transfer paper, or printed onto a sheet of paper and copied onto transfer paper.

Accordingly, once artwork is selected from a computer database or scanned into a computer, it may be printed onto a suitable support, such as plain paper. The user may then personalize the desired artwork to be transferred by writing on the desired artwork or by writing on the protective folder or sheet (i.e. if the print-out is a "master") and copying the artwork and handwritten personal message onto transfer paper. Of course, after writing onto the artwork the image may then be scanned back into the computer where the handwritten personalized message alone or composite artwork/message may be reversed and reproduced onto Cycolor transfer paper, photographic transfer paper, etc. by methods known in the art. The same reversing of the handwritten message (and optionally artwork) is necessary within the copier if a copy machine is used. This reversing of the handwritten message allows the message to be correctly printed so that it can be read in the conventional manner (i.e. left to right for English) upon transfer onto the desired receptor element. That is, software may be provided within the computer and the copier which permits the writing (and optionally artwork) to be reversed. The reversed writing would then be transferred to the printer and printed in reverse form onto the transfer sheet. Upon transfer, the personalized hand-written message would be properly oriented. The problem and solution of reversing text in transfers per se is known in the art, as is described, for example, in U.S. Pat. Nos. 4,773,953, 4,980,224 and 4,966,815.

In the case of copiers which are not capable of reversing the reproduction, the sheet having writing thereon may be overturned so that the face of the sheet that does not contain the writing (i.e. the unwritten backside of the sheet) is placed in direct contact with the supporting surface for documents to be copied (i.e. glass or plastic) and then copied so as to create a reverse image on the transfer material. Similarly, the folder containing the writing may be reverse folded so that the unwritten backside face of the member of the folder that contains the writing is placed in direct contact with the glass and then copied so as to create a reverse image on the transfer material. This procedure allows proper orientation on the transfer sheet and ultimately on the receptor element using copiers which are not capable of reversing the reproduction.

The folder, which holds the artwork, may have at least one clear, transparent member and may comprise any suitable material for protecting the artwork. This material is preferably capable of receiving ink or another similar writing fluid. The folder is preferably absorbent to receive ink or similar writing fluid. However, nonabsorbent coatings may be written on with such writing utensils as erasable markers, wax crayons, or oil pastel crayons. Similarly, the clear, transparent sheet, which protects the artwork, may be made of any suitable material, including materials preferably capable of receiving ink or another similar writing fluid. Preferably, the transparent member of the folder or sheet is flexible and composed of cellophane, cellulose acetate, mylar film, plastic (i.e. polyethylene terephthalate, polycarbonate, acetylcellulose, cellulose ester, polyvinylacetate, polystyrene, polypropylene, polyvinyl chloride, nylon, polyethylene) or the like and is most preferably of a character adapted to receive and retain ink or similar fluid. Most preferably, the folder or sheet is flexible, and the ink or fluid is erasable so that the folder or sheet may also be reused.

The clear, transparent folder or sheet preferably does not have printed windows or blocks for data entry or any other printed indicia. The transparent material should allow clear, non-interfering viewing of the artwork beneath it. In the case of a folder, no indicia is placed on the second or backing member, since it is desired to copy only the selected artwork and the personalized hand-written message onto the transfer paper.

The second member in the folder (i.e. backing for the folder) may be of the same material as the first member, or may be of any suitable backing material such as a white sheet material (i.e. white bond paper) or a colored sheet material (i.e. colored paper).

Preferably, no indicia should be located on the first or second member of the folder, or on the transparent sheet, since such indicia should not be copied onto the transfer material along with the artwork. If indicia is present on the folder or transparent sheet, it should preferably be of such a character that it will not be copied onto the transfer material. The material of the folder or transparent sheet is preferably selected so as to be sturdy enough to be reused many times during reproduction (i.e. copying) and during the handwriting process of the invention.

In another embodiment of the present invention, the folder or sheet is not entirely clear or transparent. For instance, the artwork may be inserted into a folder having a first and second member wherein at least a portion of the first member is of sufficient size for receiving a written or drawn message thereon, or inserted above (i.e. as oriented on a copying machine) at least a portion of a sheet which is of sufficient size for receiving a written or drawn message thereon, said folder or sheet is capable of being written upon and retaining writing so that the writing is visible and present only on the folder or sheet. In this way, the folder or sheet which is to be written upon may have borders (i.e. decorative) or additional artwork thereon.

The size of the transparent member of the folder or sheet is not critical. The purpose of these elements is to protect the selected artwork from being written directly upon. Therefore, the folder or sheet need only be large enough to cover the area which is being written upon. Since the folder and artwork combination or transparent sheet and artwork combination is stationary within a copier, the design of the folder or transparent cover sheet is not critical. That is, there is no need for the folder to be bigger, the same size or smaller than the artwork. Since the folder and artwork combination or sheet and artwork combination does not have to travel through a copy machine, the size of the transparent material is not critical. Whatever size that is convenient for the user may be selected, so long as the desired handwriting is positioned in the targeted location on the artwork so that the combined image is transferred onto the transfer material, which is then transferred to the receptor element. However, the folder is preferably larger than the artwork and the artwork is most preferably securely sealed in the folder.

The folder may be attached on one, two, three or all sides by any fastening means (i.e. adhesive, crimps in sides of folder, mechanical fasteners, and the like). The folder is merely a convenient means for holding the selected artwork in the copier. However, a clear, transparent sheet is sufficient since it is not necessary that the artwork is held in the copier in any special manner. The folder and the sheet are convenient means for receiving the handwriting, when applied, and for protecting the artwork for reuse.

The sheet that contains the handwriting may simply be placed in front of the artwork in a copier machine so that the writing is in the desired position on the artwork. In this way, upon copying, the transfer material will contain both artwork and personal message "written" thereon in the desired position without the assistance of a computer. In order to make sure that the handwriting is in the desired location, the folder or sheet may be divided (i.e. into quadrants) so that the artwork and personalized handwriting are placed in the desired location.

It is unnecessary to utilize adhesive between the transparent member of the folder or sheet and the artwork. Alternatively, each original piece of artwork may either be permanently or semipermanently positioned in its own folder via adhesive. The folder is preferably one that is capable of receiving a fluid, such as ink. This fluid is preferably erasable. In this way, each original piece of artwork is protected and may be used time and time again.

In the case where both members of the folder are not clear and transparent, the folder may be a document carrier comprising a planar paper back member 10, preferably rectangular and flexible, covered by a liftable transparent rectangular sheet 8. In order to use the folder, sheet 8 is raised, and the artwork 4 is inserted with the rear surface thereof atop back member 10. Depending upon their size with relation to back member 10, several pieces of artwork may be inserted thereupon simultaneously. Transparent sheet 8 is then dropped over artwork 4 which is thus held between sheet 8 and member 10, and the document carrier/folder is ready for copying onto transfer paper.

The transparent folder or sheet and art-work combination is not a pressure sensitive system such that when writing is applied onto the surface of the folder or sheet, said writing is transferred to the artwork beneath the sheet. On the contrary, the present invention preserves the artwork positioned within the folder or above the sheet when positioned in the copier so that the artwork may be reused. Moreover, in the present invention, the artwork placed within the folder or beneath the sheet in (step i) is not pressure sensitive.

In the present invention, several pieces of artwork may be placed within the folder or above the cover sheet when positioned in the copier, preferably in such a way so that the artwork does not overlap. In a preferred embodiment of the invention, only a single piece of artwork, such as a decal, is placed within the transparent folder or above the transparent cover sheet when positioned in the copier.

Artwork as defined herein is broadly defined in the conventional sense and includes illustrative and decorative elements of printed materials. However, in the present invention, artwork can also include written text, such as jokes or comments, or advertisements, as is frequently seen on tee shirts. Preferably, artwork of the invention is not a plurality of stacked paper sheets separably joined as a set having similar image areas and wherein each sheet has a distinct coding around a portion of its outside edge for facilitating routing, transmission to, storage in, and retrieval of each sheet from a predetermined location. The invention preferably comprises only a single transparent folder or cover sheet and not a plurality thereof.

The transparent protective sheet does not have an image receiving layer coated onto the back surface thereof.

Transfer materials per se are well known in the art, and any suitable transfer material may be used in the invention. For example Canon creative products T-Shirt Transfers TR-101 may be used. Other suitable transfer materials include those described in U.S. Pat. Nos. 4,773,953 and 4,980,224 including a transfer sheet known as "TRANSEEZE" manufactured by Kimberly-Clark Corporation or any other commercially available transfer sheet which has a substrate with a coating which is transferable to a receptor sheet upon the application of heat or pressure to the back of the substrate, and that is coated with Singapore Dammar Resin. The image-receptive heat transfer papers of U.S. Pat. Nos. 5,501,902, 5,271,990, and 5,242,739 may also be used. These papers generally have at least one film layer comprised of a thermoplastic polymer on a support. Also, personalized messages and images may be reproduced onto Cycolor transfer materials as disclosed U.S. Pat. Nos. 5,139,917 and 5,236,801, or onto silver halide transfer materials as disclosed in applications U.S. Ser. Nos. 08/659,700 now U.S. Pat. No. 5,620,598 and 08/479,409,now abandoned. Suitable transfer materials may comprise (i) any known suitable support in the field of transfer materials (i.e. paper), and (ii) coated on the support a release material that is capable of receiving an image thereon (i.e. via photocopying) such as Singapore Dammar resin, Batavia Dammar resin, accroide (yucca) resin, East India resins, Kauri resins, Manila resins, pontianak, and acrylics. Preferably, the transfer paper is capable of receiving an image during copying in a copy machine.

As discussed above, U.S. Pat. No. 5,139,917 discloses a Cycolor transfer material. Such a material comprises a support, a transfer coating and a layer of microcapsules on the transfer coating.

As discussed above, U.S. Pat. No. 5,139,917 discloses a Cycolor transfer material. Such a material comprises a support, a transfer coating and a layer of microcapsules on the transfer coating.

Methods of transferring the image to the receptor elements are also disclosed in the above-mentioned patents. That is, the transfer materials per se utilized in the present invention are known in the art, as are the methods for transferring the images to the receptor element.

The receptor element may be any desired receiver, such as textile, leather, ceramic, wool, glass, or plastic. Preferably, the receptor element is a shirt, tee shirt or the like.

The invention is applicable to Cycolor transfer technology as discussed above. Thus, the personalized message may be scanned into a computer and printed onto Cycolor transfer paper along with the desired artwork. The most recent version of a Cycolor printer was exhibited in November, 1996, at the COMDEX trade show in Las Vegas, Nev.

The invention is also applicable for use on transfer paper utilized in Thermal Wax Ribbon printing technology. Thus, the transfer paper intended for use for Thermal Wax Ribbons may be inserted into the copier and used as the transfer paper of the claimed process. Alternatively, the artwork that has been personalized may be scanned into a computer and printed out onto a transfer material for use with a thermal wax ribbon printer, such as the Seiko 5401 sheet fed printer. Other commercially available copiers or printers include Sharp CX 5000 model color copier and Toshiba 5400 model. Panasonic, Fargo, Cal Comp and Mitsubishi also manufacture thermal ribbon printers and/or copiers.

The invention is also applicable to transfer paper currently utilized in laser printing. The most popular models and the ones typically used for fabric transfers are Canon Laser copiers 500, 600, 700 and 800 models.

The invention is further applicable to transfer paper currently utilized in ink jet printing. For instance, CANON has a well known Bubble Jet line of transfer products that may be utilized in their printers. Other manufacturers of Ink Jet copiers and/or printers include Hewlett-Packard, Epson, Xerox, Lexmark, Mannesman Tally and Hitachi.

The image together with the handwriting may be copied directly onto these transfer papers via a conventional copier, or first scanned into a personal computer and printed onto any desired transfer paper in the desired printer.

The following example is provided for a further understanding of the invention, however, the invention is not to be construed as being limited thereto.

EXAMPLE

A decal showing a picture of the Golden Gate Bridge is inserted into a clear, transparent, flexible, plastic folder so that the image is showing through a first face of the folder and the back of the decal is on the second face of the folder. A person than takes a pen containing erasable ink and writes on the first face of the folder showing the Golden Gate Bridge the following message: "I Had a Great Time in San Francisco!". The first face of the folder containing the writing and showing the image is placed into a copy machine in a position such that the first face showing the image and writing will be copied. The first face is copied onto an 8.5×11 inch sheet of Canon creative products T-Shirt Transfers TR-101, and separately onto transfer papers from each of U.S. Pat. Nos. 5,501,902, 5,271,990, 5,242,739. The image is then transferred to a tee shirt with a hand held iron sold for use in a consumers' home in the manner described in each of these patents. For example, in the case of Canon TR-101, a household iron is preheated on its highest setting for about 8 minutes. A pillowcase is folded in half and placed on a formica surface. A light colored cotton T-shirt is placed on the pillowcase with the transfer, printed side down, placed onto the garment. The iron is then pushed along the back side of the transfer material, thereby transferring the image to the T-shirt.

The message on the front of the folder is erased (i.e. with water or with a solution of detergent and water or with a household cleaner), and the decal is available for reuse.

The contents of each of the above-mentioned U.S. patents are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

I claim:

1. A method of transferring artwork to a receptor element, which comprises the steps of:

(step i):

selecting pre-existing artwork or creating original artwork, inserting said selected pre-existing artwork or created original artwork into a folder having a first and second member wherein at least one of the first or second members is clear and transparent, or inserting said selected pre-existing artwork or created original artwork beneath a clear, transparent sheet, said folder or clear sheet is capable of being written upon and retaining writing so that the writing is visible and present only on the folder or sheet, and hand-writing directly onto the folder or sheet, thereby personalizing said folder or sheet, (step ii):

reproducing said selected pre-existing art-work or created original artwork and said folder or sheet having handwriting thereon onto a transfer material, and (step iii):

transferring said reproduced selected pre-existing artwork or reproduced created original artwork together with said reproduced handwriting from (step ii) onto a receptor element, thereby personalizing said receptor element, and (step iv):

recovering said selected art-work or created original artwork.

2. The method of transferring artwork to a receptor element according to claim 1, wherein in (step i) the folder or sheet has no indicia or printing or formwork thereon.

3. The method of transferring artwork to a receptor element according to claim 1, wherein said selected artwork or created artwork is a photograph.

4. The method of transferring artwork to a receptor element according to claim 1, wherein said selected artwork or created artwork is inserted into said folder.

5. The method of transferring artwork to a receptor element according to claim 1, wherein in (step i), said selected artwork or created artwork is inserted beneath said sheet.

6. The method of transferring artwork to a receptor element according to claim 1, wherein said handwriting must include more writing than a name of a person signing the folder or sheet.

7. The method of transferring artwork to a receptor element according to claim 1, wherein said transfer material is a transfer material comprising a support, a transfer coating and a layer of microcapsules on the transfer coating.

8. The method of transferring artwork to a receptor element according to claim 1, wherein said receptor element is a tee shirt.

9. The method of transferring artwork to a receptor element according to claim 1, wherein in (step i), a plurality of artwork is placed within the folder or beneath the sheet.

10. The method of transferring artwork to a receptor element according to claim 1, wherein in (step i) a single piece of artwork is placed within the folder or beneath the sheet.

11. The method of transferring artwork to a receptor element according to claim 1, wherein the artwork placed within the folder or beneath the sheet in (step i) is not pressure sensitive.

12. The method of transferring artwork to a receptor element according to claim 1, wherein said method of transferring does not involve the use of a personal computer.

13. The method of transferring artwork to a receptor element according to claim 1, wherein said step of reproducing said selected pre-existing art-work or created original artwork and said folder or sheet having handwriting thereon onto a transfer material is by copying on a copy machine.

14. The method of transferring artwork to a receptor element according to claim 1, wherein said folder or sheet has decorative borders or artwork thereon.

15. The method of transferring artwork to a receptor element according to claim 13, wherein in the case of a copy machine which is not capable of reversing an image, and after (step ii) and before (step iii), the sheet having writing thereon is overturned so that a face of the sheet that does not contain the writing is placed in direct contact with a clear supporting surface for documents to be copied, and then copied so as to create a reverse image on the transfer material, or the folder containing the writing is reverse folded so that an unwritten backside face of the member of the folder that contains the writing is placed in direct contact with a clear supporting surface for documents to be copied, and then copied so as to create a reverse image on the transfer material.

16. A method of transferring artwork to a receptor element, which comprises the steps of:

(step i):

selecting pre-existing artwork or creating original artwork, inserting said selected pre-existing artwork or created original artwork into a folder having a first and second member wherein at least a portion of the first member is of sufficient size for receiving a written or drawn message thereon, or inserting said selected pre-existing artwork or created original artwork beneath at least a portion of a sheet which is of sufficient size for receiving a written or drawn message thereon, said portion of folder or sheet is capable of being written upon and retaining writing so that the writing is visible and present only on the folder or sheet, and hand-writing directly onto the folder or sheet, thereby personalizing said folder or sheet, (step ii):

reproducing said selected pre-existing art-work or created original artwork and said folder or sheet having handwriting thereon onto a transfer material, and (step iii):

transferring said reproduced selected pre-existing artwork or reproduced created original artwork together with said reproduced handwriting from (step ii) onto a receptor element, thereby personalizing said receptor element, and (step iv):

recovering said selected art-work or created original artwork.

17. A method of transferring artwork to a receptor element, which comprises the steps of:

(step i):

selecting pre-existing artwork or creating original artwork, (step ii):

inserting said selected pre-existing artwork or created original artwork into a folder having a first and second member, or inserting said selected pre-existing artwork or created original artwork beneath a sheet, wherein said folder or sheet has decorative borders or artwork thereon (step iii):

reproducing said selected pre-existing art-work or created original artwork and said folder or sheet onto a transfer material, (step iv):

transferring said reproduced selected pre-existing artwork or reproduced created original artwork from step (iii) onto a receptor element, and (step v):

recovering said selected art-work or created artwork.

18. A method of transferring artwork to a receptor element, which comprises the steps of:

(step i):

selecting pre-existing artwork or creating original artwork, (step ii):

inserting said selected pre-existing artwork or created original artwork into a folder having a first and second member wherein at least one of the first or second members is clear and transparent, or inserting said selected pre-existing artwork or created original artwork beneath a clear, transparent sheet, wherein said folder or sheet has decorative borders or artwork thereon, (step iii):

reproducing said selected pre-existing art-work or created original artwork and said folder or sheet onto a transfer material, (step iv):

transferring said reproduced selected pre-existing artwork or reproduced created original artwork from (step iii) onto a receptor element, and (step v):

recovering said selected art-work or created artwork.

19. The method of transferring artwork to a receptor element according to claim 18, wherein said selected artwork or created artwork is a photograph.

20. The method of transferring artwork to a receptor element according to claim 18, wherein said selected artwork or created artwork is inserted into said folder.

21. The method of transferring artwork to a receptor element according to claim 18, wherein in (step ii) said selected artwork or created artwork is inserted beneath said sheet.

22. The method of transferring artwork to a receptor element according to claim 18, wherein said transfer material is a transfer material comprising a support, a transfer coating and a layer of microcapsules on the transfer coating.

23. The method of transferring artwork to a receptor element according to claim 18, wherein said receptor element is a tee shirt.

24. The method of transferring artwork to a receptor element according to claim 18, wherein in (step ii) a plurality of artwork is placed within the folder or beneath the sheet.

25. The method of transferring artwork to a receptor element according to claim 18, wherein in (step ii) a single piece of artwork is placed within the folder or beneath the sheet.

26. The method of transferring artwork to a receptor element according to claim 18, wherein in (step ii) the artwork placed within the folder or beneath the sheet is not pressure sensitive.

27. The method of transferring artwork to a receptor element according to claim 18, wherein only a single folder or cover sheet is provided.

28. The method of transferring artwork to a receptor element according to claim 18, wherein the said method of transferring does not involve the use of a personal computer.

29. The method of transferring artwork to a receptor element according to claim 16 wherein said step of reproducing said selected pre-existing art-work or created original artwork and said folder or sheet having handwriting thereon onto a transfer material is by copying on a copy machine.

* * * * *